US008123342B2

(12) United States Patent
Ujita et al.

(10) Patent No.: US 8,123,342 B2
(45) Date of Patent: Feb. 28, 2012

(54) LIQUID CONTAINER

(75) Inventors: Toshihiko Ujita, Yokohama (JP); Takashi Fukushima, Yokohama (JP); Akihiko Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 12/474,795

(22) Filed: May 29, 2009

(65) Prior Publication Data

US 2009/0303298 A1 Dec. 10, 2009

(30) Foreign Application Priority Data

Jun. 6, 2008 (JP) ..... 2008-149377
May 15, 2009 (JP) ..... 2009-118831

(51) Int. Cl.
*B41J 2/175* (2006.01)

(52) U.S. Cl. ..... 347/86

(58) Field of Classification Search ..... 347/7, 84–87
See application file for complete search history.

(56) References Cited

U.S. PATENT DOCUMENTS 5,616,929 A 4/1997 Hara ..... 250/573
5,689,290 A 11/1997 Saito et al. ..... 347/7
6,361,136 B1 * 3/2002 Watanabe et al. ..... 347/7
6,454,400 B1 9/2002 Morita et al. ..... 347/86
7,147,312 B2 12/2006 Ujita ..... 347/86
7,172,259 B2 2/2007 Uchikata ..... 347/7
2008/0018720 A1 1/2008 Fukushima et al. ..... 347/86
2008/0021170 A1 1/2008 Fukushima et al. ..... 525/340
2008/0129804 A1 6/2008 Fukushima et al. ..... 347/86

FOREIGN PATENT DOCUMENTS

JP 2000-34287 2/2000
JP 2000-43287 2/2000

* cited by examiner

*Primary Examiner* — An Do
(74) *Attorney, Agent, or Firm* — Fitzpatrick, Cella, Harper & Scinto

(57) ABSTRACT

Multiple grooves are formed along an inclination face of a prism-like part. A pitch of the grooves is smaller than the wavelength of light, specifically infrared light, used as a light source for detecting an ink amount. When sufficient amount of contained ink is consumed to expose the prism-like part, ink on the inclination face is held in the grooves due to their capillary force. At this time, if an amount of the ink exceeds the capacities of the grooves, no capillary force acts on the excessive ink. Accordingly, the excessive ink becomes an ink pool and slides down to an ink surface. Since the face provided with the grooves at the pitch smaller than the wavelength of the detection light source serves as a plane face optically, detection with high reliability is made possible.

16 Claims, 6 Drawing Sheets

LIQUID CONTAINER

BACKGROUND OF THE INVENTION

1. Field of the Invention

The present invention relates to a liquid container in the form of an ink tank having a chamber for directly containing ink being print liquid for use in an inkjet printing apparatus.

2. Description of the Related Art

As a method for detecting an amount, or presence and absence, of ink reserved in an ink tank used in an inkjet printing apparatus, a method employing an optical technique is known. U.S. Pat. No. 5,689,290 discloses one configuration example for the method in which a light emitter and a light receiver are arranged in such a manner as to face each other with the ink tank in between, and whether or not light passes through the ink tank is detected. In addition, for example, U.S. Pat. No. 5,616,929, U.S. Pat. No. 7,172,259 and the like disclose a configuration in which a prism portion is provided to an inner wall of an ink tank. In this configuration, whether or not the light reaches a light receiver by being reflected from the prism portion is detected. This configuration utilizes a difference between deflection of the light when ink is in the ink tank and deflection of the light when ink is not in the tank.

FIGS. 3A and 3B show a basic configuration example of an ink tank equipped with a prism. FIG. 3A is a cross-sectional view showing the overall configuration of the ink tank, and FIG. 3B is a cross-sectional view taken along the IIIb-IIIb line in FIG. 3A. The ink tank includes an accommodating chamber 704 for a negative pressure generating member, and a liquid containing chamber 707. The ink tank is detachably mounted on an inkjet print head which is not shown. The accommodating chamber 704 accommodates the negative pressure generating member 701, and includes a liquid supply port 702 for the inkjet print head and an air communication portion 703 through which outside air is introduced along with consumption of ink contained. The liquid containing chamber 707 includes a communication portion 705 communicating with the accommodating chamber 704 for the negative pressure generation member, and forms a substantially hermetically enclosed space. The liquid containing chamber 707 is a container in which ink is directly reserved. A prism 700 is provided at a bottom face of the liquid containing chamber 707 so as to be used for detection of presence and absence of contained liquid (ink) 706.

FIG. 4 is a view illustrating a prism-type detection mechanism using the prism 700, and shows a positional relationship among the prism 700 provided at the bottom face of the ink tank, a light emitting element 808 for irradiating light to the prism 700 and a light receiving element 809 for receiving the light reflected from the prism 700.

As shown in FIG. 4, the prism 700 is molded integrally with a bottom face 810 of the ink tank. The cross section of the prism 700 has a shape in which two inclination faces 804 form an angle of 90° (FIG. 3B). For example, the basic wall thickness of the ink tank is 1.7 mm to 2.0 mm, and he vertex of the 90° angle of the prism 700 protrudes from an inner surface of the bottom face 810 toward the inside of the ink tank by a height of 3.2 mm.

The light emitting element 808 is outside and below the ink tank, and light therefrom incidents on the prism 700. When the ink tank contains sufficient ink, the ink is in contact with a surface of the prism 700. In such a case, incident light on the prism 700 travels optical paths indicated by (1) and (2'), and is thereby absorbed into the ink from the inclination face 804 of the prism. Accordingly, the light does not return to the light receiving element 809. In contrast, in a case where the ink in the ink tank has been consumed and the ink is not in contact with a surface of the prism 700, incident light on the prism 700 is reflected from the inclination surface 804 previously being an interface with the ink, and thereby travels optical paths indicated by (1) and (2), and then (3) to reach the light receiving element 809.

As described, whether light irradiated by the light emitting element 808 returns to the light receiving element 809 depends on whether the ink is in the ink tank, and presence and absence of ink can be detected based on this.

Note that the light emitting element 808 and the light receiving element 809 are usually provided to the main body of the printing apparatus. Generally, in an actual system, the presence or absence of ink is determined based on a threshold, considering influences such as background light. The ink presence or absence is detected based on whether an amount of the reflected light exceeds the threshold or not.

What is demanded in recent inkjet printing apparatuses is high-quality, high-speed image formation as well as reduction in costs of the apparatuses themselves and the running costs. The prism-type detection mechanism as described above is used for warning an occasionally occurring shortage of remaining ink, and is therefore not a factor of determining the basic performance of the printing apparatus, such as quality and speed. However, if printing must be redone due to running out of ink, consumables, such as ink and printing media, and time are wasted. If provided to the printing apparatus, the prism-type detection mechanism, which has a simple configuration, can be very effective in avoiding such a waste of consumables and time. In that sense, it can be said that the above-described prism-type detection mechanism is a reasonable mechanism for detecting the level or presence/absence of ink in the ink tank.

To perform such optical detection, ink drops left on the inner walls of the ink tank can be problematic. In other words, even when the ink is not in the ink tank, the light is not reflected from the prism if ink drops are present on an optical path for the optical detection. This hinders detection of ink shortage.

For example, U.S. Pat. No. 5,689,290 proposes a configuration for actively causing ink drops not to remain on the inner wall by providing the inner face of the ink tank with grooves through which the ink drops flow down. Moreover, Japanese Patent Laid-Open No. 2000-43287 proposes a technique of making adhesion of ink drops unlikely by water-repelling the inclination faces of the prism.

The above-described groove formation in the inner wall of the ink tank and water-repelling of the inclination faces of the prism are techniques for causing ink drops, which would affect optical detection, not to be present on the processed surface.

However, depending on the kind of ink contained (e.g., pigment ink), such countermeasures sometimes cannot shed the ink drops from the wall as expected. The water-repelling effects may vary, and satisfactory water-repelling effects might not be obtained.

Meanwhile, recent inkjet printing apparatuses have a higher printing speed with an increase in the number of nozzles and in the ejection frequency. Along with this, the consumption speed of ink is increased. Accordingly, the prism-type detection mechanism is required to make its detection quickly to be commensurate with the ink consumption speed. In reality, however, there is a time lag of several minutes or more.

FIG. 5 shows results of measurements of change in outputs of the light receiving element after the occurrence of ink shortage in an ink tank having the same prism and the same configuration. The output of the light receiving element corresponds to an amount of reflected light from the prism. What can be seen from FIG. 5 is that, although the amount of reflected light increases over time, each of the results shows a time lag between the occurrence of ink shortage and when the light amount reaches a high value, and there is variation among the results as well.

As shown in FIG. 6, the time lag occurs when ink drops 1004 exist for a certain period of time by randomly adhering to one inclination face 1002 and to the other inclination face 1003 after appearance of the prism 700 from an interface 1001 between ink and air. The higher the ink consumption speed, the more likely the ink drops 1004 adhere. The ink consumption speed very much depends on a percentage of ink dots in a printing surface of a printing medium (print duties).

In study over preparation for demands expected in the future in an inkjet printing apparatus capable of printing with even higher speed, the present inventors have reached the following findings.

Specifically, in regular character printing and photo printing, the print duties are relatively low, and oftentimes, the inkjet printing apparatus is used while taking stops between operations. Accordingly, an amount of ink adhering to the prism surface is little or, if there is any, very slight. Therefore, the ink amount detection is carried out without any problems, and it is very unlikely that the ink runs out during the printing operation.

On the other hand, in printing posters or banners, the print duties are high, and on top of that, the continuous printing operation oftentimes lasts a long period of time. In such a case, large ink drops might possibly adhere to the prism surface, which causes a time lag unignorable in the ink amount detection. If such a time lag occurs, ink runs out during the printing operation, and the consumables and time are consequently consumed wastefully.

A possible measure to solve the above problem is to improve the light amount of the light emitting element 808 and/or the sensitivity of the light receiving element 809. However, such improvement of the performances of the elements produces a harmful effect of increased costs for the elements. In addition, another harmful effect is the increased possibility of involuntary detection of background light, which is unrelated to ink consumption.

U.S. Pat. No. 6,454,400 proposes a configuration in which, in addition to the water-repelling of the prism surface as described earlier, a groove is formed around the prism in such a manner as to encircle the prism, and another groove extends from the encircling groove to a chamber accommodating an absorber. In this configuration, through the grooves, ink around the prism is actively introduced to the chamber accommodating the absorber. In this event, ink likely to remain on the prism inclination face is also brought along promptly. Thereby, ink is prevented from remaining on the prism surface in form of drops. This configuration is described as a method of making the ink drop adhesion unlikely, and this method has already been in practical use.

However, depending on the kind of ink contained (e.g., pigment ink), such a configuration still might not be able to shed the ink drops from the wall face as expected, and variation in the water-repelling effects may prevent satisfactory water-repelling effects from being obtained as described above.

SUMMARY OF THE INVENTION

The present invention has been made to solve the problem that a prism-type ink detection mechanism causes ink drops to remain, depending on an environment of usage. An objective of the present invention is to make detection of an amount of liquid (ink) possible with low-cost, reliable, and stable operations.

In an aspect of the present invention, there is provided an ink tank used for a printer including a light emitter that emits infrared light and a light receiver that receives reflected light of the emitted infrared light, the ink tank comprising:

an ink chamber in which ink is directly reserved; and a prism included in the ink chamber and used in detection of the ink in the ink chamber by employing the infrared light, the prism having a surface inclined with respect to a direction in which the infrared light is incident, wherein the surface of the prism is provided with a plurality of grooves formed therein at a pitch being equal to or smaller than a wavelength of the infrared light used in the detection of the amount of the ink.

In another aspect of the present invention, there is provided liquid container comprising:

a liquid containing chamber in which liquid is directly reserved; and a prism included in the liquid containing chamber and having a surface inclined with respect to a direction in which infrared light is incident, the infrared light being used in detection of the liquid in the liquid containing chamber, wherein the surface of the prism is provided with a plurality of grooves formed therein at a pitch being equal to or smaller than a wavelength of the infrared light.

In the present invention, when a sufficient amount of contained liquid such as ink is consumed, the liquid on the inclination surface is held in grooves by their capillary force. At this time, when the amount of the liquid exceeds the capacities of the grooves, no capillary force acts on the excessive liquid. Accordingly, the excessive liquid pool slides down to the liquid surface. Consequently, no large liquid pool remains on the prism inclination surface to hinder the light reflection, allowing speedy, reliable, and stable detection of the liquid.

Moreover, in the optical liquid detection using a prism, infrared light is used as a light source. The widths and the pitch of the grooves can be set smaller than the wavelength of light by setting them smaller than 1 μm (which is equal to or smaller than the wavelength of the infrared light). When the prism is used with a sensor using infrared light, the surface of the prism can serve substantially as a plane face for the infrared light. Thereby, the prism can efficiently reflect the infrared light, allowing the liquid to be optically detected with high reliability.

Further features of the present invention will become apparent from the following description of exemplary embodiments (with reference to the attached drawings).

DESCRIPTION OF THE EMBODIMENTS

The present invention will be described below in detail with reference to the drawings.

Figure 3A:
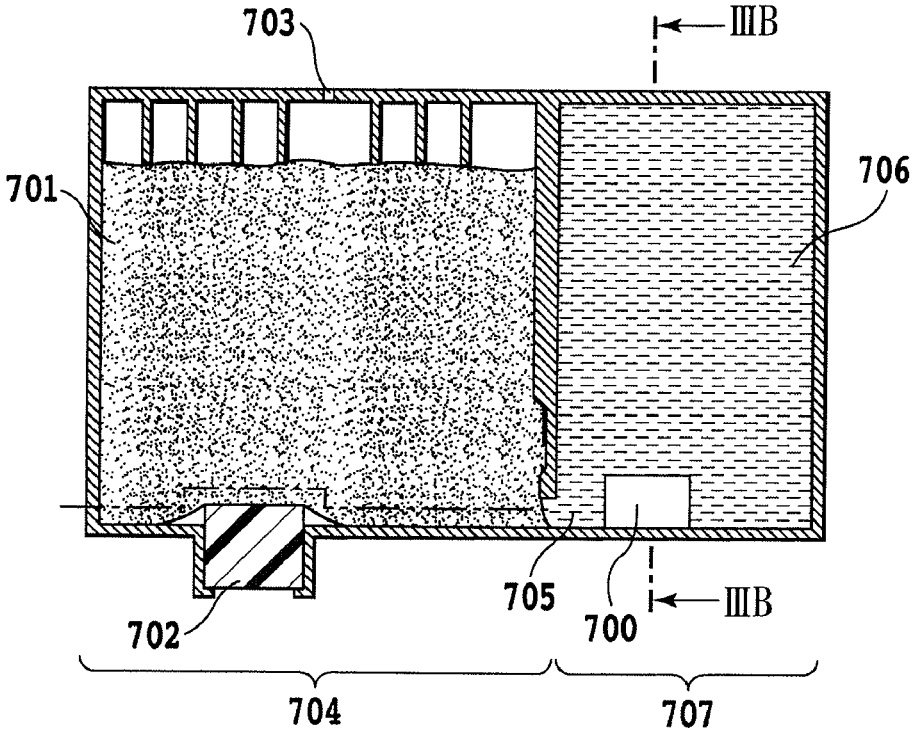
FIG. 3A is a cross-sectional view showing the overall configuration example of an ink tank equipped with a prism, to which the present invention is applied.
Figure 3B:
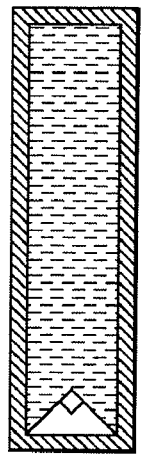
FIG. 3B is a cross-sectional view taken along the IIIb-IIIb line in FIG. 3A.
Figure 4:
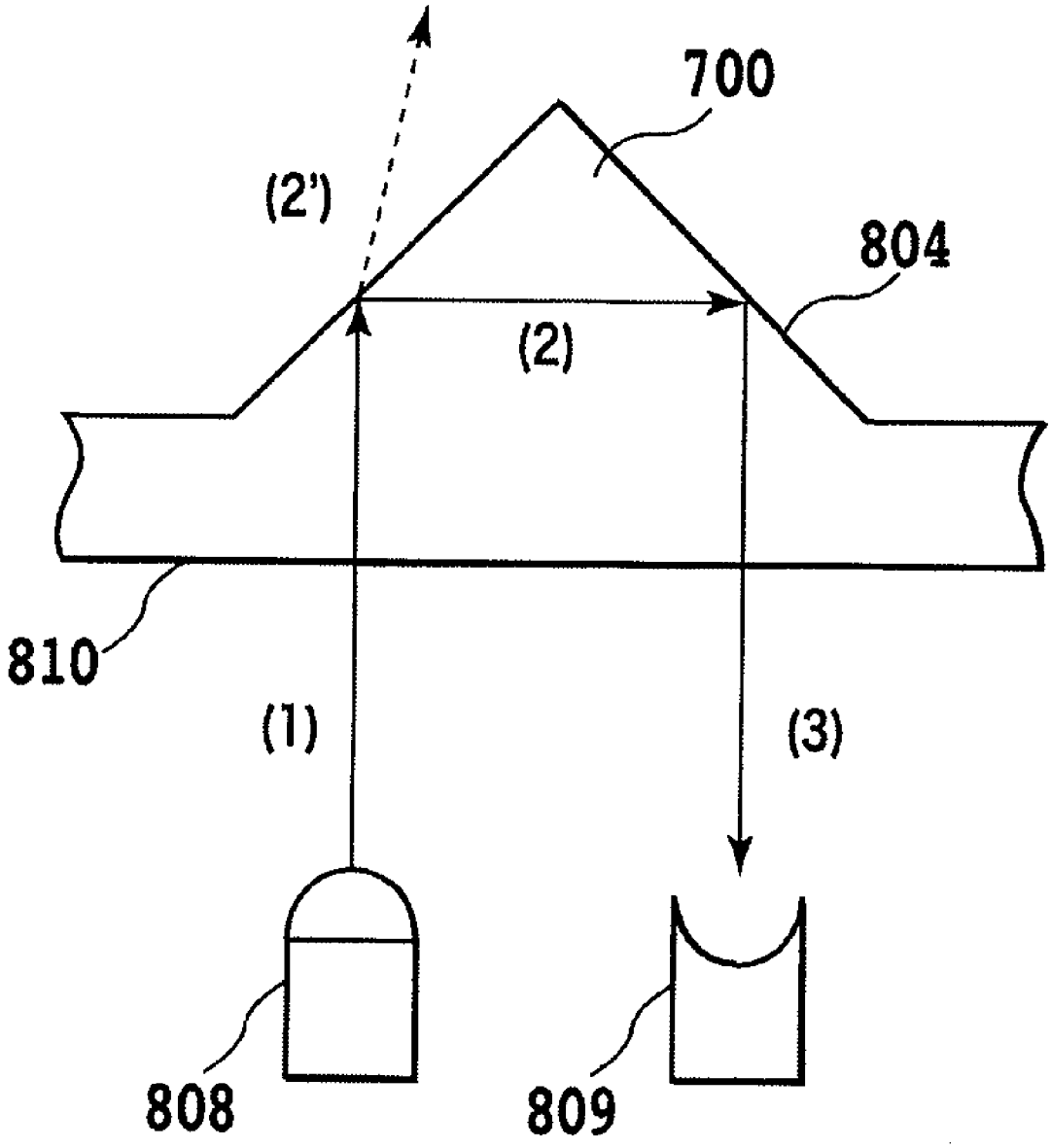
FIG. 4 is a view illustrating a prism-type detection mechanism using the prism in FIG. 3.
Figure 5:
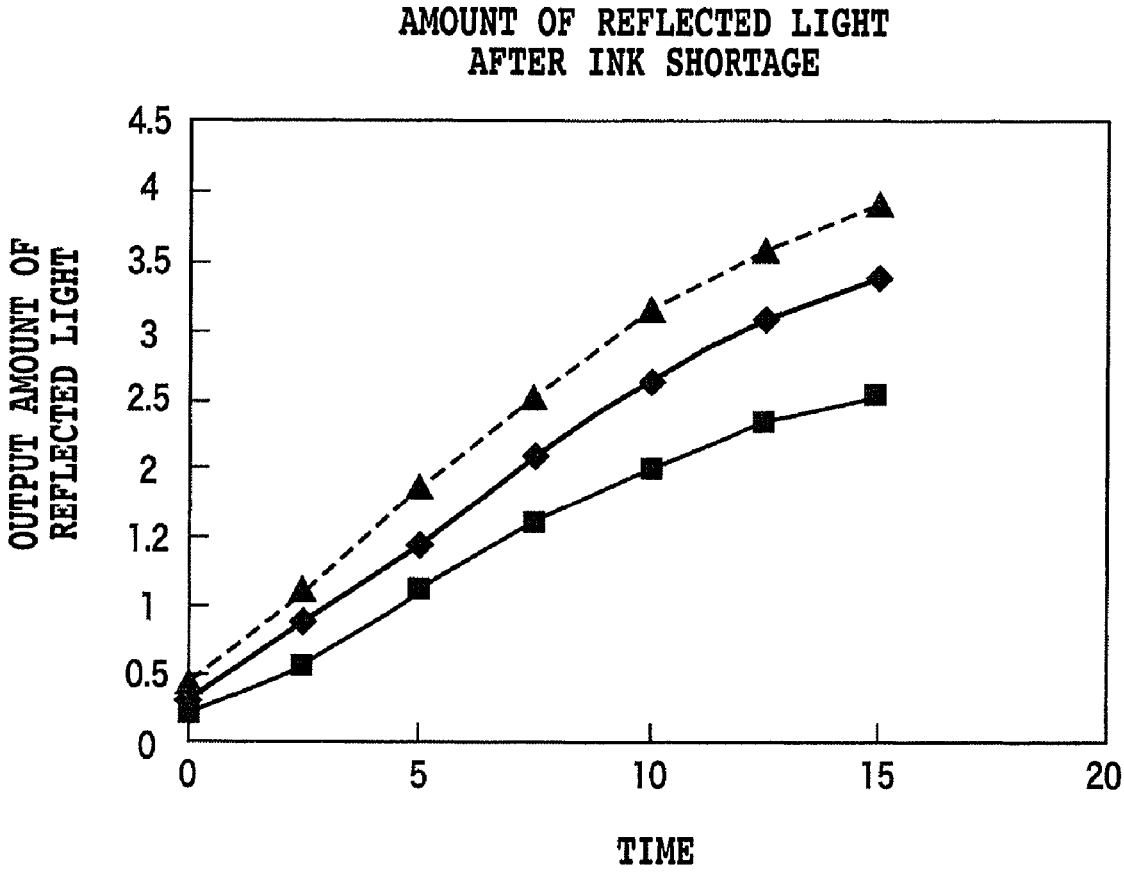
FIG. 5 is a view illustrating changes in output of a light receiving element after occurrence of ink shortage in an ink tank having a prism of a conventional configuration, the output of the light receiving element corresponding to an amount of reflected light from the prism, and FIG. 5 showing delays in the ink detection caused when the prism of a conventional configuration is used.
Figure 6:
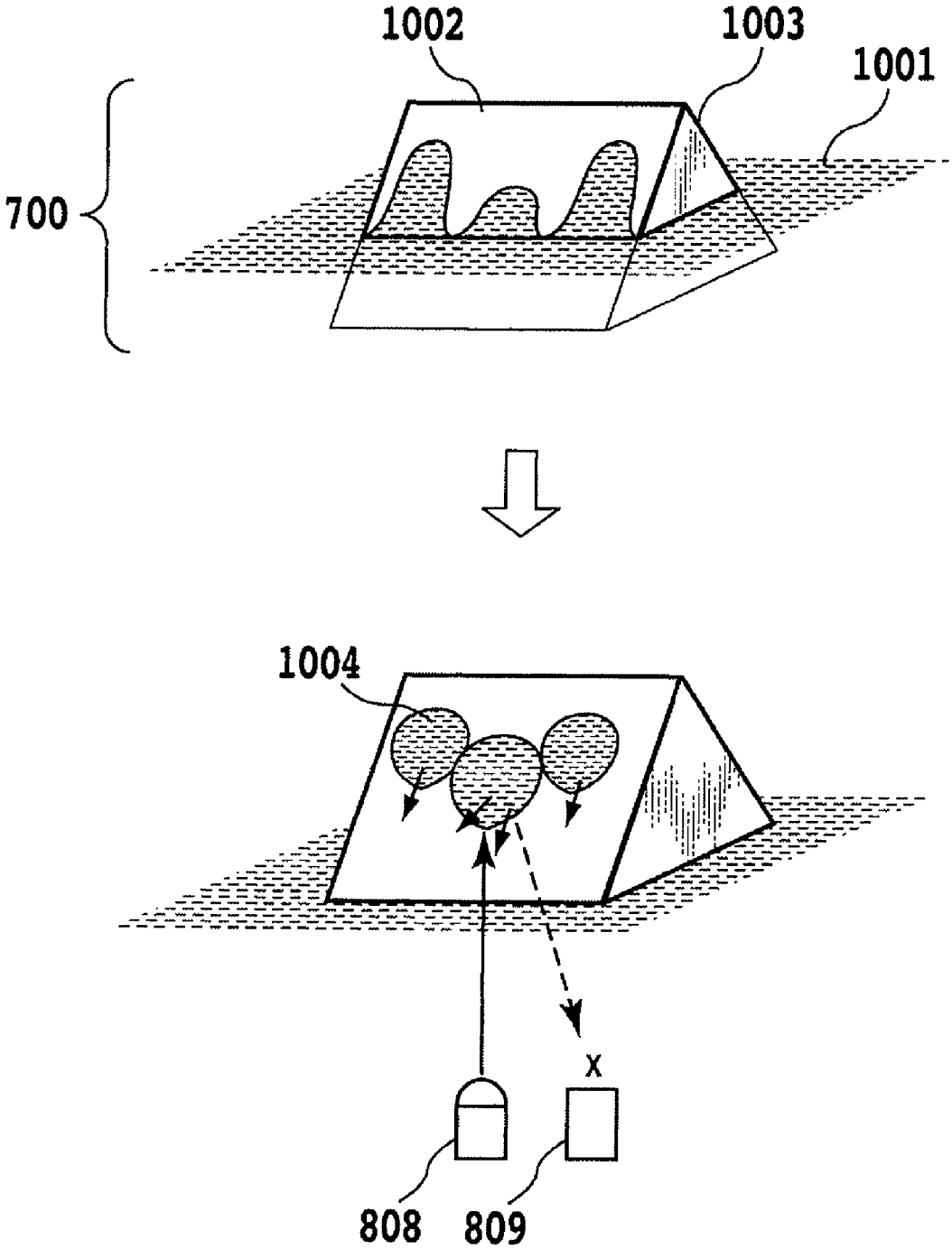
FIG. 6 is a view illustrating why the delays in the ink detection are caused when the prism of the conventional configuration is used.

Note that, in the embodiment described below, the present invention is applied to an ink tank having the configuration shown in FIG. 3, which is used in an inkjet printing apparatus.

In the following description, "ink" indicates liquid applied to a printing medium for: forming an image, a design, a pattern or the like; treating a printing medium; or performing processing on ink or on a printing medium. The processing mentioned here is performed for example for improvement of the fixability of ink applied to a printing medium through coagulation or insolubilization of a color material of the ink, improvement of print quality or color reproduction, or improvement of image durability.

FIGS. 1A to 1D are schematic perspective views illustrating the configuration and operations of a prism forming a main part in an ink tank according to the embodiment of the present invention. The present embodiment describes a case preferable when light applied by a light emitting element 808 is infrared light having a wavelength of 0.7 μm to 1 μm. An infrared light sensor is widely used in general because of its characteristics of receiving little influence of visible light disturbance. There are many types of infrared light sensors, and they are inexpensive.

A concept of a technique used by the present invention is described below.

Light reflected from a mirror surface has a reflection angle of $-\theta$ when its incident angle is $\theta$. Whether or not a wall serves as a mirror surface depends on a relationship between a wavelength $\lambda$ of light and depths D and a pitch P of asperities on the reflection wall. For example, as shown in FIG. 2A, assume that the relationship between the wavelength $\lambda$ of light and the pitch P of the asperities on the reflection wall is as follows.

$$p>\lambda \quad (1)$$

In this case, the wall does not serve as a mirror surface. Accordingly, being influenced by the shapes of the asperities on the wall, light having entered at the incident angle $\theta$ does not reflect at the reflection angle $-\theta$.

Figure 2B:
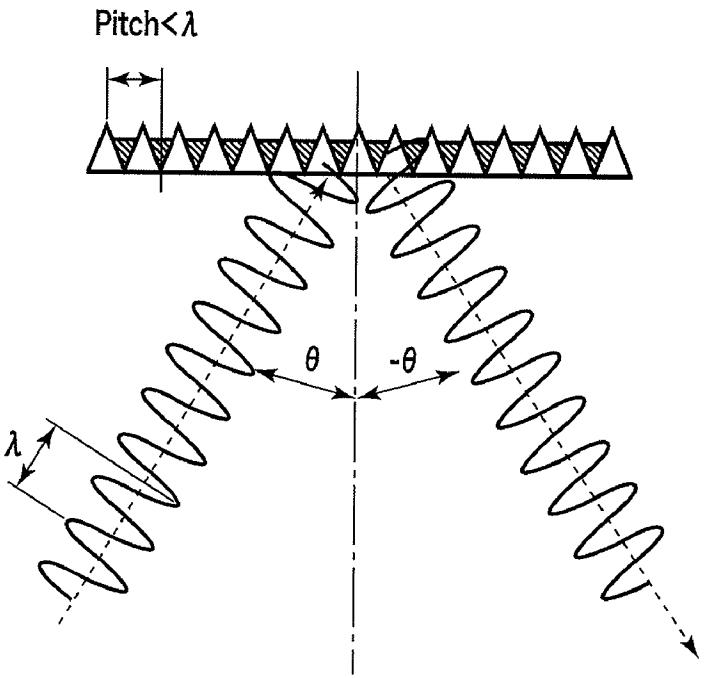
FIGS. 2A and 2B are conceptual views illustrating states of light, FIG. 2A showing a state of light when a pitch of asperities on a reflection wall is larger than the wavelength of incident light, and FIG. 2B showing a state of light when the pitch of asperities on a reflection wall is smaller than the wavelength of incident light.
Figure 2A:
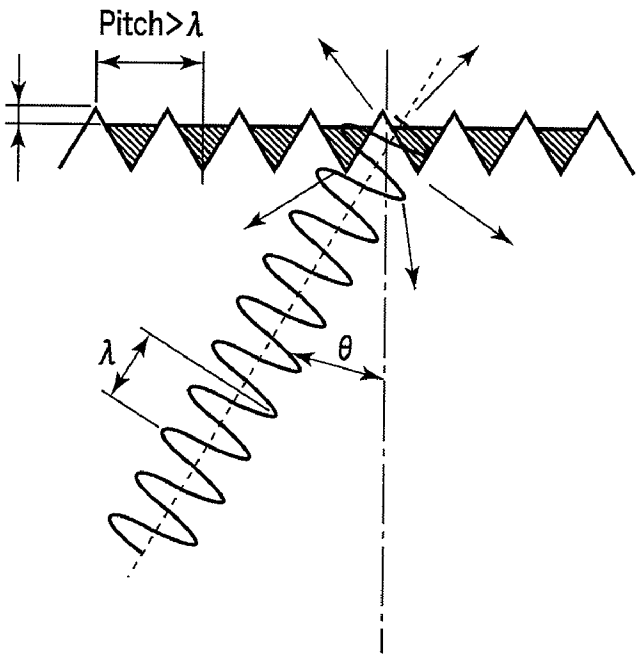

On the other hand, as shown in FIG. 2B, assume that the relationship between the wavelength $\lambda$ of light and the pitch P of the asperities on the reflection wall is as follows.

$$p<<\lambda \quad (2)$$

In this case, the wall serves substantially as a mirror surface for the wavelength. Accordingly, the reflection angle is $-\theta$ when the incident angle is $\theta$.

Figure 1A:
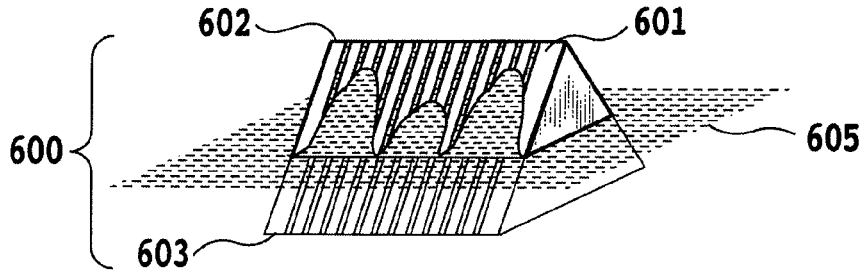
FIGS. 1A to 1D are schematic perspective views illustrating the configuration and operations of a prism forming a main part in an ink tank according to an embodiment of the present invention.
Figure 1B:
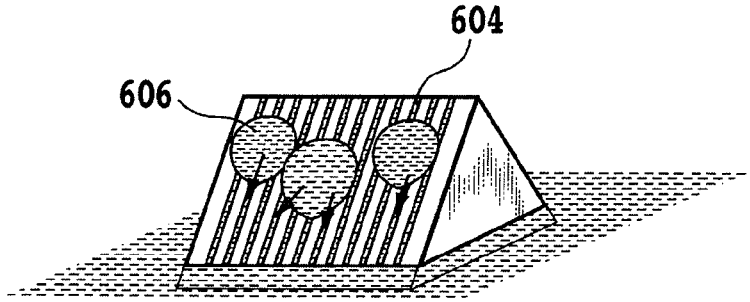
Figure 1C:
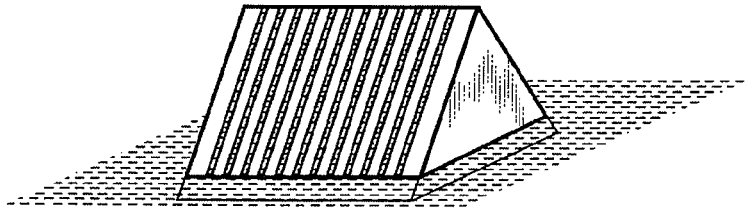
Figure 1D:
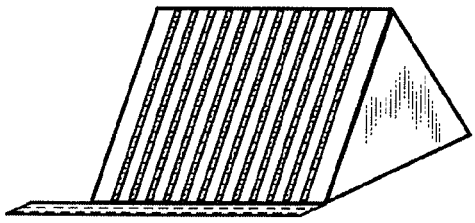

As shown in FIG. 1D, fine grooves are formed in a surface (reflection surface) of the prism according to the present embodiment, and ink stably exists in these grooves by their capillary force. Ink in the grooves is a very thin film, so that the ink absorbs very little light. Optically, the cross-section shape of the prism surface has asperities at equally-spaced intervals, and the prism surface therefore functions so that the reflection angle may be $-\theta$ when the incident angle is $\theta$, as described above.

Note that the wavelength $\lambda$ of infrared light used by an optical ink detection mechanism in the inkjet printing apparatus is from 1 μm to 100 μm. Accordingly, by forming grooves whose widths and the pitch thereof are each smaller than 1 μm (not over the wavelength) in the prism surface, ink drops do not remain on the prism surface, and the prism surface can serve as what can be considered as a mirror surface as described above. This allows optical detection with high reliability.

Being resistant to receiving visible light noise, infrared light is effective as a light source for optical detection. Infrared region sensors are preferable as a light source for optical detection for a printer since they are relatively inexpensive and readily available.

In a prism 600 of the present embodiment, multiple V-shaped grooves 604 are formed in parallel to each other along an inclination surface 601 from a ridge line 602 including a vertex portion of the prism to a foot portion 603 of the prism. The ink tank (FIG. 3) and the prism 700 used in the ink tank are integrally formed by injection molding using a transparent resin. At this time, the multiple V-shaped grooves 604 can be formed simultaneously. Here, each of the V-shaped grooves can have a depth of 0.4 μm and an aperture angle of 30°, and a pitch of the grooves can be 0.8 μm. In this case, if, for example, a prism has a 6 mm width, 7500 of V-shaped grooves can be formed. The V-shaped grooves 604 are formed in parallel to an optical path defined by a positional relationship between the light emitting element 808 applying light to the prism 600 and a light receiving element 809. This is in order for the shapes of the V-shaped grooves not to become a factor of diffusing the light, to thereby suppress the light diffusion to minimum.

As shown in FIG. 1A, the prism inclination surface 601 and the V-shaped grooves 604 are partially exposed from a surface of ink 605 as the amount of the ink 205 in a liquid containing chamber 707 decreases. At this time, sufficient reflection of the incident light is not obtained.

Then, as shown in FIG. 1B, most part of the prism 600 appears from the ink surface when a sufficient amount of the ink 605 is consumed. Here, the ink on the prism inclination surface 601 is held in the V-shaped grooves 604 by their capillary force. At this time, when the amount of the ink exceeds the capacities of the grooves, no capillary force acts on the excessive ink. Accordingly, the excessive ink becomes ink pools 606 and slides down to the ink surface. Consequently, as shown in FIG. 1C, the large ink pools 606, which would hinder the light reflection, do not remain on the prism inclination surface, and the ink always stably exists in the V-shaped grooves 604 only. Thereby, stable reflection can be obtained.

When the ink is further consumed in such a stable state to lead to a state where there is substantially no ink remaining in the liquid containing chamber 707, the prism 600 appears completely as shown in FIG. 1D. In this state as well, stable reflection can be obtained. Here, when the V-shaped grooves are formed such that the capillary force thereof is greater than that of the negative pressure generation member 701 formed of an absorber and a foam material, the same state can be maintained even when there is substantially no ink remaining in the liquid containing chamber 707.

The pitch and the depths of the V-shaped grooves 604 of the present embodiment are each smaller than the wavelength of the infrared light. In optical principle, the infrared light is reflected in a manner of plane surface reflection. Accordingly, in the present embodiment, large ink pools do not remain on the prism surface, which is a smooth surface in the conventional example, when there is substantially no ink remained. In addition, the reflection surface serves as a plane surface optically by using infrared light, and consequently, stable remaining amount detection is made possible.

(Others)

It should be noted that the groove shape, the groove dimension and the pitch of the grooves formed in the prism are not limited to the exemplified ones given in the embodiment described above. It goes without saying that the shape, dimension and pitch can be set to any appropriately selected values as long as they effectively allow ink pools not to remain on the prism inclination surface. The ink pools would otherwise hinder optical detection in an event where there is substantially no ink remaining. Moreover, instead of equally forming grooves having the same shape and dimension in the inclination surface at the same pitch, grooves having different shapes and dimensions may be formed at appropriate pitches.

For example, the grooves formed in the prism surface may have any shape and dimension as long as they can hold the ink with their capillary force and are formed at a pitch and with widths smaller than the wavelength of the light source for ink remaining amount detection, which is provided to the printer. For example, the grooves may have a V-shaped wedge or a rectangular shape in cross section. In addition, there may be a plurality of mixed variations of the width and the pitch of the plurality of grooves, as long as each of the variations being equal to or smaller than the wavelength of the light source for ink detection.

Furthermore, the grooves are preferably formed from the vertex potion to the foot portion of the prism, and are formed at least so that ink not being held in the grooves flows down and does not remain as ink drops.

Moreover, an example described above is a case where the present invention is applied to an ink tank (FIG. 3) which is attached detachably to an inkjet print head. However, it goes without saying that a concept of the present invention is also applicable to a print head unit (liquid containing cartridge) in which the ink tank and the inkjet print head are integrally formed so as not to allow detachment from each other.

Further, the present invention is also applicable to an ink tank which is attached to an inkjet printing apparatus as discrete from an inkjet print head and which supplies ink to the inkjet print head through a tube or the like. In addition, the ink tank may be of a type being replaced, or a type being replenished with ink by injection, when there is substantially no ink in the ink tank.

In either type, application of the present invention allows employment of an inexpensive ink tank which makes it possible to detect an ink amount with high reliability. In particular, in a case where the ink tank or the print head unit integrally including the ink tank is to be replaced when there is substantially no ink in the ink tank, the running costs to be defrayed by the consumers is reduced effectively since the manufacturing costs of the ink tank is reduced.

Additionally, the ink tank described in the above embodiment includes a prism having two inclination surfaces. However, the present invention is also applicable to an ink tank having, near its bottom surface, a single inclination surface to allow ink pool hindering optical detection not to remain. The single inclination surface is inclined relative to an incident direction of light from a light emitting element and can reflect the light toward a light receiving element positioned in a direction different from the incident direction.

Furthermore, the present invention is applicable not only to an ink tank for containing ink as liquid, but also to other liquid containers as long as they have an inclination surface used for optical detection of contained liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-149377, filed Jun. 6, 2008, and 2009-118831, filed in May 15, 2009, which are hereby incorporated by reference herein in their entirety.

What is claimed is:

1. An ink tank used for a printer including a light emitter that emits infrared light and a light receiver that receives reflected light of the emitted infrared light, the ink tank comprising:

an ink chamber in which ink is directly reserved; and a prism included in the ink chamber and used in detection of the ink in the ink chamber by employing the infrared light, the prism having a surface inclined with respect to a direction in which the infrared light is incident, wherein the surface of the prism is provided with a plurality of grooves formed therein at a pitch being equal to or smaller than a wavelength of the infrared light used in the detection of the amount of the ink.

2. The ink tank according to claim 1, wherein a width of each of the grooves formed in the surface of the prism is equal to or smaller than the wavelength of the infrared light.

3. The ink tank according to claim 2, wherein there are a plurality of mixed variations of the width and the pitch of the plurality of grooves, each of the variations being equal to or smaller than the wavelength of the infrared light.

4. The ink tank according to claim 2, wherein the width and the pitch of the plurality of grooves are each smaller than 1 μm.

5. The ink tank according to claim 1, wherein the grooves in the surface of the prism are formed in such a manner as to connect a vertex portion and a foot portion of the prism.

6. The ink tank according to claim 1, wherein the plural grooves are formed on an ink-facing surface of the prism.

7. A liquid container comprising:

a liquid containing chamber in which liquid is directly reserved; and a prism included in the liquid containing chamber and having a surface inclined with respect to a direction in which infrared light is incident, the infrared light being used in detection of the liquid in the liquid containing chamber, wherein the surface of the prism is provided with a plurality of grooves formed therein at a pitch being equal to or smaller than a wavelength of the infrared light.

8. The liquid container according to claim 7, wherein the plural grooves are formed on an ink-facing surface of the prism.

9. An ink tank used for a printer including a light emitter that emits infrared light and a light receiver that receives reflected light of the emitted infrared light, the ink tank comprising:

an ink chamber in which ink is reserved;

a prism provided in the ink chamber and used for detecting whether an ink amount in the ink chamber is high or low by employing the infrared light, the prism having an inclined surface with respect to a direction in which the infrared light is incident; and plural grooves formed in the inclined surface, wherein pitch between any adjacent grooves in the plural grooves is equal to or smaller than a wavelength of the infrared light.

10. The ink tank according to claim 9, wherein width of each groove formed in the inclined surface is equal to or smaller than the wavelength of the infrared light.

11. The ink tank according to claim 10, wherein there are a plurality of mixed variations of the width and the pitch of the plural grooves, each of the mixed variations being equal to or smaller than the wavelength of the infrared light.

12. The ink tank according to claim 10, wherein the width and the pitch are each smaller than 1 μm.

13. The ink tank according to claim 9, wherein the plural grooves in the inclined surface are formed in such a manner as to connect a vertex portion and a foot portion of the prism.

14. The ink tank according to claim 9, wherein the plural grooves are formed on an ink-facing surface of the prism.

15. An ink tank comprising:

an ink chamber in which ink is reserved;

a prism provided in the ink chamber and having an inclined surface for detecting whether an ink amount in the ink chamber is high or low by employing infrared light; and plural grooves formed in the inclined surface, wherein pitch between any adjacent grooves in the plural grooves is equal to or smaller than a wavelength of the infrared light.

16. The ink tank according to claim 15, wherein the plural grooves are formed on an ink-facing surface of the prism.

* * * * *